US007944402B2

(12) United States Patent
Zhao et al.

(10) Patent No.: US 7,944,402 B2
(45) Date of Patent: May 17, 2011

(54) DIPOLE ANTENNA CAPABLE OF SUPPORTING MULTI-BAND COMMUNICATIONS

(75) Inventors: Shi-Ming Zhao, Taipei (TW); Ding-Bing Lin, Taipei County (TW); Chao-Hsiung Tseng, Miaoli County (TW); Jui-Hsien Chien, Kaohsiung (TW); Shiao-Ting Wu, Kaohsiung County (TW)

(73) Assignee: Sumwintek Corp., Hsinchu County (TW)

( * ) Notice: Subject to any disclaimer, the term of this patent is extended or adjusted under 35 U.S.C. 154(b) by 466 days.

(21) Appl. No.: 12/116,224

(22) Filed: May 7, 2008

(65) Prior Publication Data

US 2009/0278758 A1 Nov. 12, 2009

(51) Int. Cl.
*H01Q 9/26* (2006.01)

(52) U.S. Cl. ..... 343/803; 343/793; 343/804

(58) Field of Classification Search ..... 343/700, 343/793, 803, 804, 806, 895
See application file for complete search history.

(56) References Cited

U.S. PATENT DOCUMENTS

| | | | | |
|---|---|---|---|---|
| 6,888,511 | B2 * | 5/2005 | Cake | 343/803 |
| 6,980,173 | B2 * | 12/2005 | Man et al. | 343/841 |
| 2005/0024287 | A1 * | 2/2005 | Jo et al. | 343/822 |
| 2005/0093677 | A1 * | 5/2005 | Forster et al. | 340/10.1 |

* cited by examiner

*Primary Examiner* — Tho G Phan
(74) *Attorney, Agent, or Firm* — Rosenberg, Klein & Lee

(57) ABSTRACT

According to one embodiment of the present invention, a dipole antenna capable of supporting multi-band communications, includes a first portion of the antenna in a folded structure, a second portion of the antenna that includes a first coupling pad and a second coupling pad physically separated by a distance, and a current path along the first portion of the antenna and the second portion of the antenna, wherein a first portion of the current path that includes the first coupling pad and the second coupling pad is configured to introduce a slow wave effect if electric current flows through the first portion of the current path.

25 Claims, 4 Drawing Sheets

DIPOLE ANTENNA CAPABLE OF SUPPORTING MULTI-BAND COMMUNICATIONS

BACKGROUND OF THE INVENTION

1. Field of the Invention

The present invention relates generally to antenna related technologies, especially an antenna capable of supporting multi-band communications.

2. Description of the Related Art

The development of wireless communication systems and devices has increased dramatically over recent years. Various products and techniques have been developed to support multi-band communications to meet increasing consumer demands. For example, some laptop computers or mobile phones equipped with wireless capabilities can now receive and display digital signals typically for digital televisions.

Such digital television signals are subject to regulations. For example, the frequency range for the digital television signals, as regulated by the Digital Video Broadcast (DVB) consortium, is from 470-860 MHz. This frequency range however differs from the frequency (e.g., 2.45 GHz) used by other wireless applications, such as WiFi and Bluetooth, that may be supported by the same laptop computers or mobile phones. To support a wide range of frequencies, traditional design approaches may involve multiple antennas.

Conventional antennas generally adapted in wireless communication systems and devices are grouped into two types, monopole antennas and dipole antennas. A monopole antenna typically has a simple structure and covers a wide range of frequencies, but requires a considerably wide ground plane to achieve the desired radiation efficiency. In addition, a monopole antenna is best used for a specific frequency band, such as the frequency band for devices operating according to the Code Division Multiple Access (CDMA) protocol or the frequency band for devices operating according to the Global System for Mobile communications (GSM) protocol.

A dipole antenna generally includes a pair of wires and is driven by a voltage signal applied to the center of the antenna. The dipole antenna effectively radiates and receives electromagnetic waves and is used in various communication fields. For the conventional dipole antenna to maintain optimal polarization effects, its dimension cannot be effectively reduced. Similar to the monopole antenna discussed above, the dipole antenna is also best suited to operate in a single frequency band.

As has been discussed, both the conventional monopole antenna and the conventional dipole antenna need to maintain certain sizes to achieve desirable effects. Furthermore, to cover a wide range of frequencies, an antenna including multiple antenna elements, each of which is responsible for a particular frequency range, is typically used. With the multiple antenna elements and some required distance to separate among the antenna elements, reducing the size of the antenna becomes challenging. Also, some signal control may be required in each of the antenna elements, which complicates communication processing and causes an increase in power consumption. Some other problems associated with using multiple antenna elements include the difficulty of mounting the antenna elements and the potential interferences among the antenna elements.

Hence, it is expected that an antenna only operating in a single frequency band is not a cost-effective solution, especially with a wireless communication system and device continuing to be miniaturized. Therefore, what is needed in the art is an antenna capable of supporting multi-frequency communications and addresses at least the problems set forth above.

SUMMARY OF THE INVENTION

A dipole antenna capable of supporting multi-band communications is disclosed. According to one embodiment of the present invention, the antenna includes a first portion of the antenna in a folded structure, a second portion of the antenna that includes a first coupling pad and a second coupling pad physically separated by a distance, and a current path along the first portion of the antenna and the second portion of the antenna, wherein a first portion of the current path that includes the first coupling pad and the second coupling pad is configured to introduce a slow wave effect if electric current flows through the first portion of the current path.

At least one advantage of the present invention is to provide an antenna that supports multiple frequency bands without adding size to such an antenna.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the drawings. It is to be noted, however, that the drawings illustrate only typical embodiments of this invention and are therefore not to be considered limiting of its scope, for the invention may admit to other equally effective embodiments.

DETAILED DESCRIPTION

Figure 1:
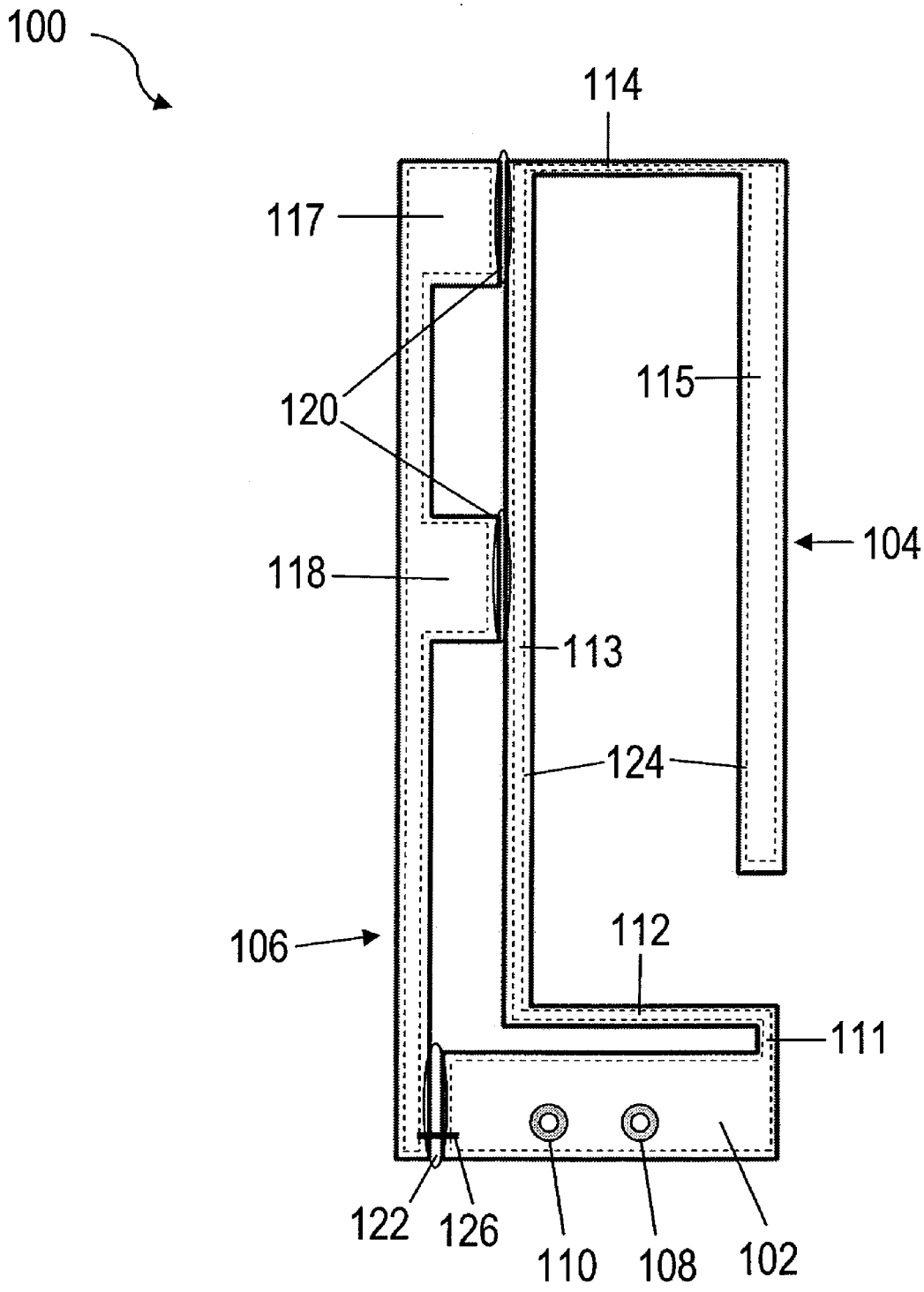
FIG. 1 illustrates a structure of an antenna, according to one embodiment of the present invention.

FIG. 1 illustrates a structure of an antenna 100, according to one embodiment of the present invention. The antenna 100 can be considered as a folded dipole antenna. In one embodiment, the illustrated antenna 100 covers three frequency bands. The antenna 100 includes a conductive region 102, a radiating arm 104 responsible for a first frequency range (e.g., a low frequency band), and a radiating arm 106 responsible for a second frequency range (e.g., a high frequency band).

The two radiating arms correspond to conductive structures in which current flows to establish two sets of resonant conditions for the antenna 100. Specifically, a first set of frequency resonant conditions is established by having current flown through the radiating arm 104, and a second set of frequency resonant conditions is established by having current flown through the radiating arm 106. The radiating arm 104 and the radiating arm 106 are configured with proper coupling to provide adequate current flow along their respective paths and to produce the desired resonant conditions. In one embodiment, the antenna covers an area with a width of 28 mm and a length of 75 mm.

In one implementation, the antenna 100 further comprises a feed point 108 and a ground point 110 on the conductive region 102. Electric current enters through the feed point 108, travels along a current path 124 as along the radiating arms 104 and 106, and exits through the ground point 110 to generate resonances at certain frequencies. The conductive region 102 may be used as a storage unit for the electric current, if the current is introduced from the feed point 108. The size of the conductive region 102 may affect the desired resonant frequency and may be adjusted to introduce the desired resonant frequency. Due to the asymmetric shapes of the radiating arms 104 and 106, the current entering and exiting through the feed point 108 and the ground point 110 allows for resonances at multiple frequencies therefore widening the frequency the antenna 100 covers. In one implementation, a coaxial line may be used for feeding the electrical signal to the antenna 100. In another implementation, the coaxial line may be positioned in the center or at the side of the conductive region 102 of the antenna 100. In yet another implementation, a 50Ω mini coaxial line may be used for feeding to the antenna 100, with one end, typically the central probe, connected to the feed point 108, and another end, typically the grounding probe, connected to the ground point 110.

As mentioned above, in another embodiment of the present invention, the radiating arm 104 acts as a ground for the radiating arm 106. The two radiating arms 104 and 106 may be connected together by a thin trace 126. The thin trace 126 allows the antenna 100 to implement a Low Noise Amplifier (LNA), which is a special type of electronic amplifier used in communication systems to amplify weak signals captured by an antenna, and is often located close to the antenna. The thin trace 126 has low enough impedance to keep the two radiating arms close to the same potential while preventing the electric current of one radiating arm from impacting the other. The closer the LNA is to the antenna, the loss of electric current through the feed point is less critical. By implementing the LNA into the antenna structure itself, it increases the performance of the antenna 100 without adding additional size to the antenna 100.

According to the embodiment of FIG. 1, the radiating arm 104 is made up of multiple segments in a folded structure. This folded structure also includes a number of acute angled bends (≦90 degrees) among the segments. For example, one end of a first segment 111 is connected to the conductive region 102. The other end of the first segment 111 is bent at a 90-degree angle and is connected to a second segment 112. A third segment 113 is connected to the second segment 112 and is in parallel with the first segment 111. A forth segment 114 is bent at another 90-degree angle and is connected to the third segment 113. A fifth segment 115 is then bent another 90-degree and is connected to the forth segment 114. A space 119 is formulated among the segments 111-115. The segments 111-115 are coupled to and are also in the same plane as the conductive region 102. The folded structure extends length to the current path 124 without increasing the overall size of the antenna 100.

In one implementation, the radiating arm 106 is of a straight structure with coupling pads 117 and 118. The coupling pads 117 and 118 may be used to attract electric current and increase the density of the electric current, which causes the traveling speed of the electric current along the current path to slow down. This is commonly referred to as a slow wave effect. The slow wave effect can be further modified by adjusting the sizes and the relative positions of the coupling pads 117 and 118 to achieve a desired resonant frequency. The positions of the coupling pads 117 and 118 may be adjusted by changing the distance between the coupling pads 117 and 118. By modifying the sizes of the coupling pads 117 and 118, the length of the current path 124 is also altered, which affects the flow of the electric current through the radiating arm 106. As the current flow increases, so does the density of the current. In one implementation, as more electric current flows through, the slow wave effect can introduce even lower resonant frequency in the low frequency band. The size of the antenna 100 can also be further reduced with the introduction of the slow wave effect.

As discussed above, the radiating arm 104 resonates at a first frequency range (e.g., a low frequency band), and the radiating arm 106 resonates at a second frequency range (e.g., a high frequency band). In addition, a first set of frequency resonant conditions is established by having electric current flown through the radiating arms 104 and 106, and a second set of frequency resonant conditions is established by having electric current flown through the radiating arms 104 and 106. In one implementation, the frequency resonant conditions are governed by the formula as provided below:

$$\lambda(\text{mm})=L(\text{m/s})/F(\text{MHz})$$

Here, L is the light speed constant; F is the desired frequency; and λ is the wavelength of a propagating wave resonating at the desired frequency. The physical size of the antenna 100 is further related to λ. In particular, the actual distance of the current path 124 is equal to a ratio of λ/2*n, in which n is a multiplier corresponding a particular frequency. For example, to satisfy the low frequency band, the actual distance of the current path 124 is equal to approximately 0.5 λ of a certain low frequency. More precisely, suppose the low frequency is at 550 MHz. λ is determined to be 545 millimeter (mm), and the physical distance of the current path 124 is determined to be 0.53λ (i.e., 292 mm.) In another example, to satisfy the high frequency band, the actual distance of the current path 124 is equal to less than 1 λ but higher than 0.5 λ of a certain high frequency. Suppose the high frequency is at 850 MHz. λ is determined to be 353 mm, and the physical distance of the current path 124 is determined to be 0.83λ (i.e., 292 mm.) It is worth noting that the physical distance of the current path 124 can be less than 1 λ is due to the slow wave effect introduced by the coupling pads 117 and 118 in the antenna structure. In particular, the speed of the electric current slows down as it travels through the coupling pads, which reduces the physical distance for the current path needed to satisfy the frequency resonant conditions, especially in the high frequency band.

Furthermore, the density of the electric current may also be affected by the gap present in the folded structure, such as a gap 120 between the third segment 113 and the coupling pad 117 and 118, and a gap 122 between the radiating arm 106 and the conductive region 102. The sizes of the gap 120 and 122 may affect the length of the electric current path and thus also affect whether the desired resonant frequency is achieved.

In one embodiment of the present invention, a portion of the current path 124 between the feed point 108 and the ground point 110 can be lengthened by utilizing additional folding structures. As discussed above, the lengthening of the current path 124 is likely to affect the performance of the antenna 100, especially regarding the frequencies at which resonant conditions are established.

In one implementation, the radiating arms 104 and 106 of the antenna 100 are formulated by stamping or cutting the desired shape from a blank sheet of conductive material. Certain regions of the stamped sheet are then shaped or bent to form the various features of the antenna. The relatively small size of the antenna 100 permits its installation in various devices and other applications where space is at a premium. The antenna 100 may be generally considered as a low-profile antenna due to its height. Compared with a typical monopole antenna or a dipole antenna, the antenna 100 is relatively small in size. Such desirable physical attributes of the antenna 100 are in part realized by employing foldable structures and by taking advantage of the slow wave effect introduced by the arrangements of the coupling pads.

Figure 2:
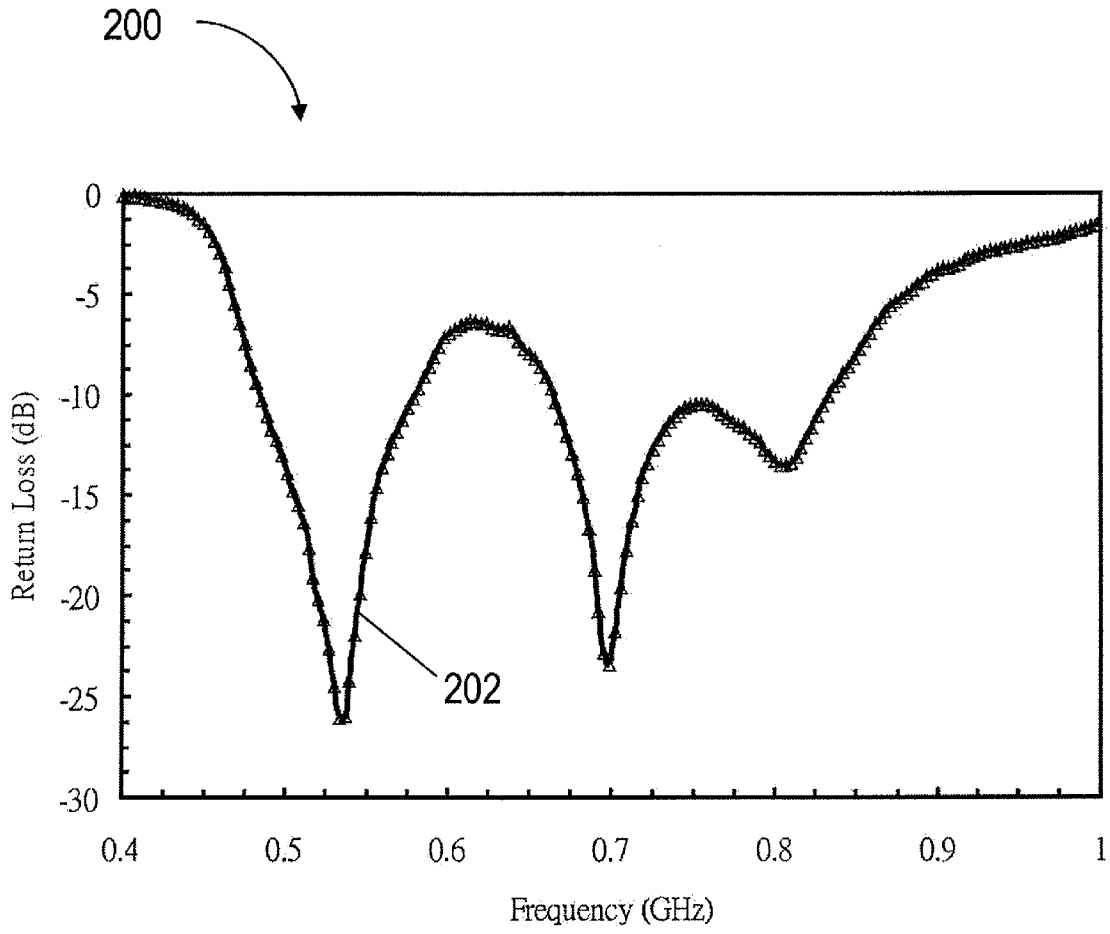
FIG. 2 is a frequency response diagram illustrating the return loss associated with the antenna of FIG. 1, according to one embodiment of the present invention.

FIG. 2 is a frequency response diagram 200 illustrating the return loss associated with the antenna 100, according to one embodiment of the present invention. As illustrated by a line 202 of FIG. 2, the antenna 100 operates in approximately the frequency range of 470-860 MHz. In other words, the combination of the radiating arms 104 and 106 and the various physical arrangements shown in FIG. 1 result in the frequency characteristics shown in FIG. 2. In this manner, the antenna 100 can tune and radiate energy in the frequency range necessary for receiving multiple standards of the digital television signals, e.g., the DVB standard and the UHF standard.

The antenna 100 may, however, be configured to resonate at other frequencies than the ones shown in FIG. 2. As described above, certain dimensions of the antenna 100 may be adjusted to realize a different set of operating frequencies. For example, the folded structure of the radiating arm 104 may be folded in a different way; the gaps 120 and 122 between the radiating arms 104 and 106 may be lengthened or shortened; the coupling pads of the radiating arm 106 may be enlarged or spaced out between each other differently; or any other dimensions of the antenna 100 may be adjusted to cause the antenna 100 to support different frequency bands.

More specifically, in one implementation, if the width of the gap 120 is set to a range between 0.5 millimeter (mm) and 2 mm, with approximately 0.5 mm yielding the optimal frequency responses, then the antenna 100 covers the frequency range of 470-860 MHz. In particular, if the gap 120 is set at 0.5 mm, then the antenna 100 is demonstrated to resonate at approximately 540, 700, and 820 MHz and to operate in the frequency range of 470-860 MHz adjacent to the resonant frequencies. Here, an optimal frequency response refers to a frequency response occurring at a desired frequency and with a desired magnitude.

In another implementation, the sizes of the coupling pads 117 and 118 of FIG. 1 are adjusted. As discussed above, modifying the physical characteristics of the coupling pads 117 and 118 may affect the slow wave effect and also the density of the electric current flowing through the antenna 100. If the size of each of the coupling pads 117 and 118 is set to a range between 6.4 mm and 10.4 mm, with approximately 10.4 mm yielding the optimal frequency responses, then the antenna 100 again covers the frequency range of 470-860 MHz. In particular, if the size of each of the coupling pads 117 and 118 is set at 10.4 mm, then the antenna 100 is demonstrated to resonate at approximately 540, 700, and 820 MHz and to operate again in the frequency range of 470-860 MHz adjacent to the resonant frequencies.

In yet another implementation, the distance of the coupling pads 117 and 118 of FIG. 1 are adjusted. If the distance between the coupling pads 117 and 118 is set to a range between 11.35 mm and 23.35 mm, with approximately 23.35 mm yielding the optimal frequency responses, then the antenna 100 again covers the frequency range of 470-860 MHz. In particular, if the distance between the coupling pads 117 and 118 is set at 23.35 mm, then the antenna 100 is demonstrated to resonate at approximately 540, 700, and 820 MHz and to operate in the frequency range of 470-860 MHz adjacent to the resonant frequencies.

In still another implementation, the size of the conductive region 102 of FIG. 1 is adjusted. As discussed above, adjusting the size of the conductive region 102, more specifically the width, causes a change to the current path 124. It may also affect the relative positions of the feed point 108 and ground point 110 and therefore affect the slow wave effect as well. If the width of the conductive region 102 is set to a range between 2 mm and 8 mm, with approximately 8 mm yielding the optimal frequency responses, then the antenna 100 again covers the frequency range of 470-860 MHz. In particular, if the width of the conductive region 102 is set at 8 mm, then the antenna 100 is demonstrated to resonate at approximately 540, 700, and 820 MHz and to operate in the frequency range of 470-860 MHz adjacent to the resonant frequencies.

In still another implementation, if the width of a gap 122 of FIG. 1 is set to a range between 1.5 mm and 2.5 mm, with approximately 1.5 mm yielding the optimal frequency responses, then the antenna 100 again covers the frequency range of 470-860 MHz. In particular, if the width of the gap 122 is set at 8 mm, then the antenna 100 is demonstrated to resonate at approximately 540, 690, and 820 MHz and to operate in the frequency range 470-860 MHz adjacent to the resonant frequencies.

Figure 3A:
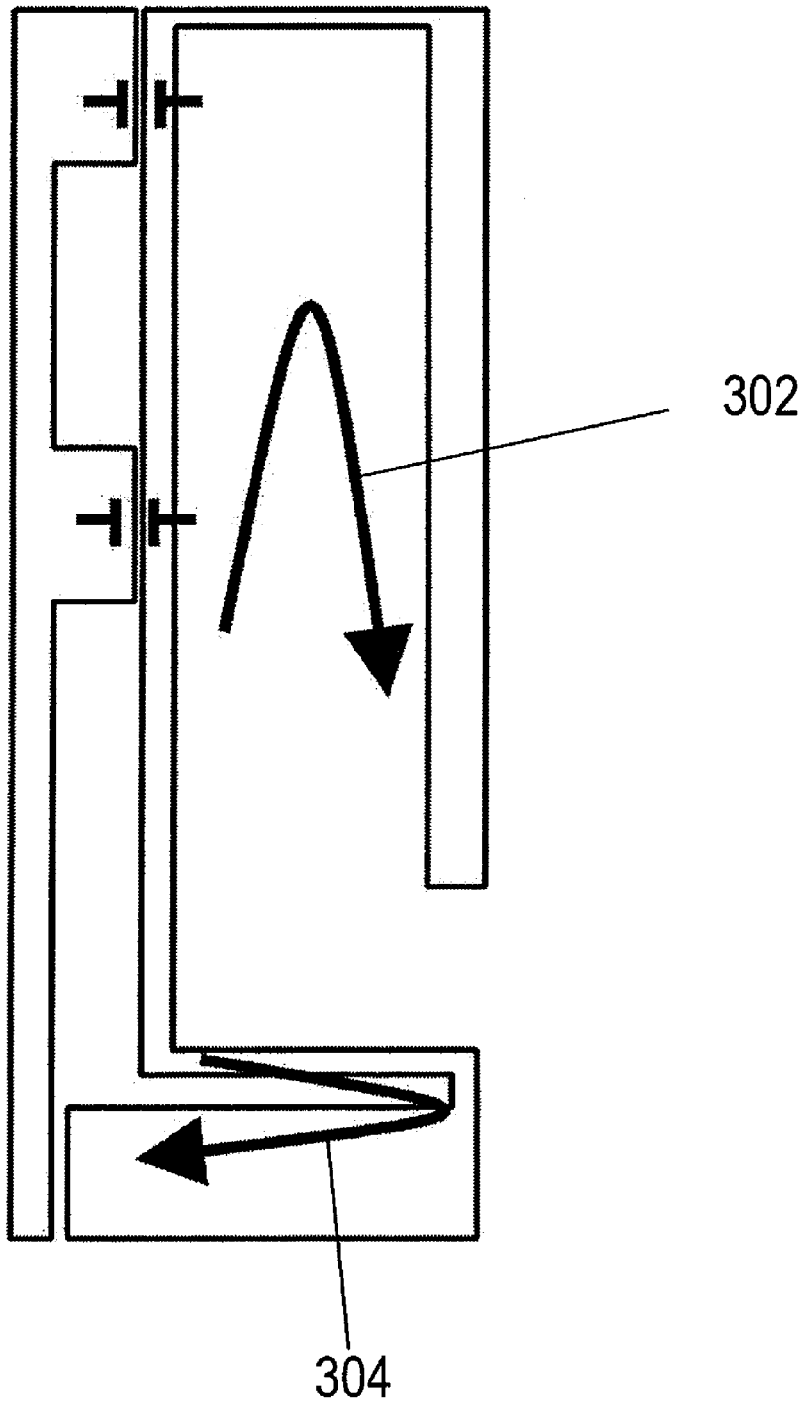
FIG. 3A illustrates the general direction of the current flow between the radiating arms of the antenna of FIG. 1, according to one embodiment of the present invention.

In conjunction with FIG. 1, FIG. 3A illustrates the general direction of the current flow between the radiating arms 104 and 106, according to one embodiment of the present invention. When the electric current comes in from the feed point 108, the electric current flows from the radiating arm 104 to the radiating arm 106. While in the radiating arm 104, the electric current travels in the direction represented by an arrow 302 along the folded segments. In one implementation, when the current travels through the folded structure of the radiating arm 104 along the current path 124, this causes the antenna 100 to resonate at a desired high frequency. The electric current also travels to the radiating arm 106 and flows in the direction represented by an arrow 304. As the electric current travels through the coupling pads 117 and 118, in effect lengthening the current path 124, this detour around the coupling pads 117 and 118 slows down the speed of the electric current, increases the density of the electrical signal, and therefore generate a desired low frequency through the slow wave effect. In addition, the coupling pads 117 and 118 also become a reservoir to store electric charges as the electric current flows through.

Figure 3B:
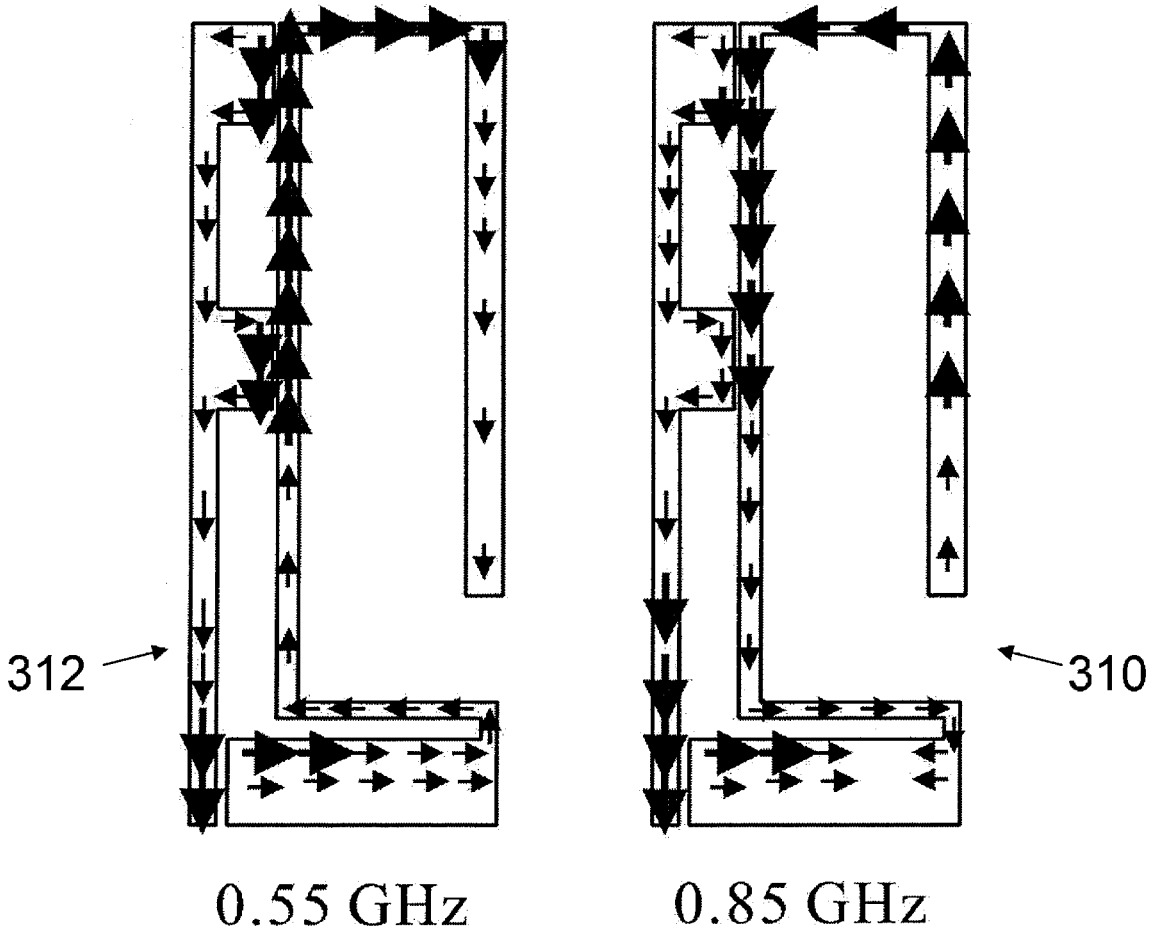
FIG. 3B illustrates the strength of the current flow between the radiating arms of the antenna of FIG. 1, according to one embodiment of the present invention.

In conjunction with FIG. 1 and FIG. 3A, FIG. 3B illustrates the strength of the current flow between the radiating arms 104 and 106, according to one embodiment of the present invention. In one implementation, the strength of the electric current flow is different in the radiating arm 104 and the radiating arm 106. The length of the arrows in FIG. 3B represents the strength of the electric current. The strength of the electric current determines the frequency range. In FIG. 3B, the high frequency band is represented by a picture 310, and the low frequency band is represented by a picture 312. While operating in the high frequency band, the strongest electric current, as represented by the enlarged arrows shown in the picture 310, primarily flows through the forth segment 114 of the radiating arm 104 of FIG. 1 at about 0.85 GHz, which is 850 MHz. While in the low frequency band, the strongest electric current, as represented by the enlarged arrows shown in the picture 312, primarily flows through an end opposite to the coupling pad 117 of the radiating arm 104 at about 0.55 GHz, which is 550 MHz. As illustrated by FIG. 3B, by applying the electric current at varying strengths to different portions of the current path 124 causes the antenna 100 to resonate at approximately 550 and 850 MHz and thus allowing the antenna 100 to operate in the frequency range adjacent to the resonant frequencies.

The above description illustrates various embodiments of the present invention along with examples of how aspects of the present invention may be implemented. The above examples, embodiments, instruction semantics, and drawings should not be deemed to be the only embodiments, and are presented to illustrate the flexibility and advantages of the present invention as defined by the following claims.

We claim:

1. A dipole antenna capable of supporting multi-band communications, comprising:

a first portion of the antenna in a folded structure;

a second portion of the antenna that includes a first coupling pad and a second coupling pad physically separated by a distance; and a current path along the first portion of the antenna and the second portion of the antenna, wherein a first portion of the current path that includes the first coupling pad and the second coupling pad is configured to introduce a slow wave effect responsive to electric current flowing through the first portion of the current path;

wherein the antenna further comprises a conductive region with a feed point and a ground point.

2. The antenna of claim 1, wherein the feed point and the ground point are coupled to a second portion of the current path and electric current enters through the feed point and exits through the ground point to generate resonances.

3. The antenna of claim 1, wherein the first portion of the antenna and the second portion of the antenna are coupled together asymmetrically.

4. The antenna of claim 1, wherein the first coupling pad and the second coupling pad are configured to increase the electric current flowing through the second portion of the antenna.

5. The antenna of claim 1, wherein the second portion of the antenna is lengthened by including a plurality of folded segments.

6. The antenna of claim 1, wherein the first portion of the antenna and the second portion of the antenna are made from a blank sheet of conductive material, wherein the physical characteristics of the first portion of the antenna and the second portion of the antenna are formed by stamping or cutting the blank sheet of conductive material.

7. The antenna of claim 1, wherein the antenna covers a frequency range of 470-860 MHz.

8. The antenna of claim 1, wherein the first portion of the antenna is configured to resonate in a low frequency band.

9. The antenna of claim 8, wherein the ratio of the distance of the current path to a wavelength of a wave resonating in the low frequency band is approximately 0.5.

10. The antenna of claim 1, wherein the second portion of the antenna is configured to resonate in a high frequency band.

11. The antenna of claim 10, wherein the ratio of the distance of the current path to a wavelength of a wave resonating in the high frequency band is less than 1 but greater than 0.5.

12. An antenna structure capable of supporting multi-band communications, comprising:

a conductive region;

a first radiating arm in a folded structure coupled to one end of the conductive region;

a second radiating arm that includes a first coupling pad and a second coupling pad physically separated by a distance coupled to another end of the conductive region; and a current path along the first radiating arm and the second radiating arm, wherein a first portion of the current path that includes the first coupling pad and the second coupling pad is configured to introduce a slow wave effect responsive to electric current flowing through the first portion of the current path;

wherein the conductive region includes a feed point to receive electric current and a ground point coupled to a second portion of the current path.

13. The antenna structure of claim 12, wherein the folded structure includes a plurality of folded segments and a number of acute angles ≦90 degrees between any two of the folded segments.

14. The antenna structure of claim 12, wherein the first coupling pad and the second coupling pad are configured to increase the current flow through the second radiating arm.

15. The antenna structure of claim 12, wherein the size of each of the first coupling pad and the second coupling pad is within a range of 6.4 millimeters and 10.4 millimeters.

16. The antenna structure of claim 12, wherein if the size of each of the first coupling pad and the second coupling pad is set at approximately 10.4 millimeters, then an optimal frequency response is achieved.

17. The antenna structure of claim 12, wherein the distance between the first coupling pad and the second coupling pad is within a range between 11.35 millimeters and 23.35 millimeters.

18. The antenna structure of claim 17, wherein if the distance between the first coupling pad and the second coupling pad is set at approximately 23.35 millimeters, then an optimal frequency response is achieved.

19. The antenna structure of claim 12, wherein the width of the gap between the first radiating arm and the second radiating arm is within a range between 0.5 millimeters and 2 millimeters.

20. The antenna structure of claim 19, wherein if the width of the gap between the first radiating arm and the second radiating arm is set at approximately 0.5 millimeters, then an optimal frequency response is achieved.

21. The antenna structure of claim 12, wherein the width of the gap between the second radiating arm and the conductive region is within a range between 1.5 millimeters and 2.5 millimeters.

22. The antenna structure of claim 21, wherein if the width of the gap between the second radiating arm and the conductive region is set at approximately 1.5 millimeters, then an optimal frequency response is achieved.

23. The antenna structure of claim 12, wherein the width of the conductive region is within a range between 2 millimeters and 8 millimeters.

24. The antenna structure of claim 23, wherein if the width of the conductive region is set at approximately 8 millimeters, then an optimal frequency response is achieved.

25. The antenna structure of claim 12, wherein the antenna structure is covered in an area with a length of 75 mm and a width of 28 mm.

* * * * *